US005962965A

United States Patent [19]

Yuki et al.

[11] Patent Number: 5,962,965

[45] Date of Patent: Oct. 5, 1999

[54] FE-NI ALLOYS HAVING IMPROVED PUNCHING PROPERTIES AND PUNCHED ELECTRON GUN PARTS FABRICATED THEREFROM

[75] Inventors: Norio Yuki; Yoshihisa Kita, both of Kanagawa-ken, Japan

[73] Assignee: Nippon Mining & Metals Co., Ltd., Tokyo, Japan

[21] Appl. No.: 08/990,636

[22] Filed: Dec. 15, 1997

[30] Foreign Application Priority Data

Mar. 24, 1997 [JP] Japan ..... 9-087321

[51] Int. Cl.[6] ..... H01J 29/48

[52] U.S. Cl. ..... 313/441; 313/407; 313/417; 445/47

[58] Field of Search ..... 313/440, 441, 313/412, 414, 417, 405, 407; 445/47

[56] References Cited

FOREIGN PATENT DOCUMENTS 3636815 10/1986 Japan ..... 313/441
06122945 5/1994 Japan .
06184703 7/1994 Japan .
07003400 1/1995 Japan .
07034199 2/1995 Japan .

*Primary Examiner*—Sandra O'Shea
*Assistant Examiner*—Joseph Williams
*Attorney, Agent, or Firm*—Scully, Scott, Murphy & Presser

[57] ABSTRACT

Disclosed are Fe-Ni alloys used for electron gun parts and press punched electron guns, typically a electron gun electrode manufactured by press punching, comprising: all by weight, 30 to 55% of Ni; 0.0010 to 0.0200% of S; 0.1 to 0.8% of Mn; no more than 0.3% of Si; no more than 0.05% of Al; no more than 0.005% of O; and the balance of substantially Fe and inevitable impurities; said alloy preferably having a crystal grain size of not less than 7.0 in grain size number based on JIS G 0551. When oxide-type inclusions are included, Mn and S which form MnS combine with the oxide-type inclusions, so that MnS which is effective for improvement of punching properties do not sufficiently precipitate. Therefore, the invention controls contents of elements forming oxides in proper ranges.

6 Claims, 2 Drawing Sheets

FE-NI ALLOYS HAVING IMPROVED PUNCHING PROPERTIES AND PUNCHED ELECTRON GUN PARTS FABRICATED THEREFROM

BACKGROUND OF THE INVENTION

This invention relates to Fe-Ni alloys with improved punching properties suitable as materials for electron gun parts, such as electrodes for electron guns, and also relates to punched electron gun parts, typically electron gun electrodes, obtained by blanking a stock of such alloy and punching small holes in the blanks for passage of electron beams therethrough.

In FIG. 1 is shown a cross section of a color picture tube of the shadow mask type already known in the art. A panel 1 is coated on the back side with a phosphor film 2 that generates the three primary colors of red, green, and blue. In the neck is housed an electron gun 4 that emits electron beams 3. The electron beams 3 are deflected in scanning by a deflection yoke 5. The numeral 6 indicates a shadow mask and the numeral 7 indicates a magnetic shield.

In FIG. 2, (a) and (b) are perspective and cross sectional views, respectively, of an electrode 10 as an example of a punched part to be fitted in the electron gun 4. The electrode 10 acts to accelerate electrons emitted from a cathode in the electron gun. The electrode has small holes 10*a*, 10*b*, and 10*c* made by coining and punching so as to allow red, green, and blue color-generating beams, respectively, to pass through them.

In general, the electron gun parts for use in picture tubes and the like are completed by blanking and press punching (called hereinafter merely punching), with or without coining, a sheet of nonmagnetic stainless steel about 0.05 to 0.5 mm thick.

As materials commonly used for electron gun parts of picture tubes and the like, nonmagnetic stainless steels are well known. Also in the case of the electrode 10 that accelerates the electrons emitted from the cathode of an electron gun, it has long been desired to have a magnetic permeability, as a measure of nonmagnetism, close to 1. Recently however, more weight has been put on low thermal expansion properties than on the permeability. With the advent of higher refinement, higher performance picture tubes for computer displays and the like in recent years, it has been noted that subtle dimensional changes with thermal expansion of electrode parts influence the picture quality (color purity) on the panel 1 (see FIG. 1). To cope with the situation, Fe-Ni alloys having low-expansion properties, notably Fe-42% Ni alloy (42 alloy), have come into use as electrode materials.

The 42 alloy of the prior art, however, presents a burr formation problem. That is, as electrode blanks of the 42 alloy are punched with a pattern of small holes 10*a*, 10*b*, and 10*c* each, burrs B are formed on the edges 10*e* of the holes where punches have forced slugs down and cut them off from the blank (see FIG. 2). The burrs that result from the punching have adverse effects upon the dimensional accuracy of electron gun parts that must meet severe precision requirements. Abnormal discharge from the burrs under high voltage sometimes proves fatal to the electron guns due to decreases in withstand voltage. The tendency toward picture tubes of even greater refinement is making the requirement for the reduction of burring from electron gun parts more and more exacting.

Improvements in the punching properties of Fe-Ni alloys have hitherto been proposed, for example, in Japanese Patent Application Kokai Nos. 6-122945, 6-184703, 7-3400, and 7-34199.

Of those proposals, Kokai No. 6-184703 specifies an S content in the range of 0.002 to 0.05% and disperses S or an S compound along grain boundaries or within grains in the alloy stock. However, the mere addition of S, a free-cutting element, in a specified percentage cannot be deemed adequate for the control of burrs in the modern punching working to most precise specifications.

The remaining Kokai Nos. 6-122945, 7-3400, and 7-34199 propose adding such strengthening elements as Ti, Nb, V, Ta, W, or/and Zr to the alloy for imparting increased hardness and proper extent of embrittlement to the alloy to suppress burring. These proposals, however, posed problems of shortened punching die life with increased hardness and of increased cost with the addition of such special elements.

This invention has for its object to settle the afore-described problems of the prior art and provide an Fe-Ni alloy for electron gun parts which is improved in punching properties without attendant shortening of die life or additional expenditure on special elements, and also provide punched parts for electron guns, typified by electron gun electrodes, made of the alloy by punching.

BRIEF SUMMARY OF THE INVENTION

The inventors have intensively studied on the influence of the chemical composition of inclusions upon the punching properties. As a result, the inventors have successfully solved the above problems by improving the punching properties of the Fe-Ni alloys used for electron gun parts through control of the composition of the inclusions by controlling the contents of S and O within specific ranges. More specifically, based on the detailed studies, the inventors have discovered that the most effective inclusion for improvement of the punching properties is MnS, and that quantity and distribution of MnS are more affected by oxide-type inclusions co-existing with than the content of S. In accordance with further detailed studies by the inventors, when the oxide-type inclusions exist, Mn and S which are expected to form MnS combine with the oxide-type inclusions, so that MnS which is the most effective inclusion for improvement of the punching properties does not sufficiently precipitate. Therefore, the present invention can provide materials satisfying the severe requirement with respect to the burrs formed on the electron gun parts for the first time by satisfying the two conditions that the content of the elements forming the oxide-type inclusions is controlled in a suitable range and a suitable content of S is added. Moreover, according to the present invention, attendant shortening of die life and additional expenditure on special elements can be prevented.

The present invention is completed based on the above mentioned knowledge. That is to say, the invention provides an Fe-Ni alloy used for electron gun parts and a press punched electron gun part manufactured from the above Fe-Ni alloy comprising: all by weight, 30 to 55% of Ni; 0.0010 to 0.0200% of S; 0.1 to 0.8% of Mn; no more than 0.3% of Si; no more than 0.05% of Al; no more than 0.005% of O; and the balance of substantially Fe and inevitable impurities.

Furthermore, the inventors discovered that it is more effective to specify a crystal grain size of the alloy in the range of not less than 7.0 in grain size number based on JIS G 0551. Therefore, the present invention further provides an Fe-Ni alloy used for electron gun parts and a press punched electron gun part, manufactured from an Fe-Ni alloy comprising: all by weight, 30 to 55% of Ni; 0.0010 to 0.0200% of S; 0.1 to 0.8% of Mn; no more than 0.3% of Si; no more than 0.05% of Al; no more than 0.005% of O; and the balance of substantially Fe and inevitable impurities, and having a crystal grain size of not less than 7.0 in grain size number based on JIS G 0551.

Wherein, a typical example of the electron gun part may be an electron gun electrode.

In the following, the reason of the above numerical limitations will be explained together with the effects of the present invention. In the following explanation, "%" means "weight %".

(Ni): Ni is an important element which determines thermal expansion characteristic of an Fe-Ni alloy. If its content is less than 30% or more than 55%, the alloy is undesirable with a too high thermal expansion coefficient. Hence the content of Ni is restricted in the range of 30 to 55%.

(S): S forms MnS together with Mn, and MnS improves the punching properties. A proper range of a content of S is affected by the amount of the oxide-type inclusions inevitably remaining in the alloy. According to the inventor's studies, the content of S should not be less than 0.0010% considering the effect of the amount of the oxide-type inclusions. On the other hand, further improvement of punching properties con not be expected with adding S beyond 0.0200%. Therefore, the content of S is restricted in the range of 0.0010 to 0.0200%.

(Mn): Mn forms MnS together with S, and MnS improves the punching properties as mentioned the above. In order to form a sufficient amount of MnS, a content of Mn must be at least 0.1%. On the other hand, if the content of Mn exceeds 0.8%, Mn combines with inevitable remaining O, so that undesirable oxide-type inclusions are easily precipitated. Therefore, the content of Mn is restricted in the range of 0.1 to 0.8%.

(Si): Si is primarily employed as a deoxidizer, and a content of remaining Si is approved within 0.3%. That is to say, if the content of the remaining Si exceeds 0.3%, the amount of remaining oxide-type inclusions becomes high, and the alloy is undesirable with the high content of the remaining oxide-type inclusions.

(Al): Al is also employed as a deoxidizer, and a content of remaining Al is approved within 0.05%. If the content of the remaining Al exceeds 0.05%, the amount of remaining oxide-type inclusions becomes high, and the alloy is undesirable with the high content of the remaining oxide-type inclusions.

(O): O forms oxide-type inclusions. According to the object of the present invention, in order to control the amount of remaining oxide-type inclusions, a content of O must be no more than 0.005%. Preferably, the content of O should be no more than 0.003%.

Further elements included in the alloy except for the above elements are Fe and inevitable impurities. The inevitable impurities may be ordinary impurities, C, P, Cr and Co. Such impurities are harmful for thermal expansion characteristic. Therefore, the entire amount of the impurities should be in the range of 10 to 2000 ppm.

Furthermore, if a crystal grain size of the alloy is not less than 7.0 in grain size number based on JIS G 0551, ductility of the matrix of the alloy is properly restricted, so that the punching properties are further improved. As indicated by the above reference numeral, the grain size number is defined by the JIS G 0551.

The inventors analysed in detail the mechanism of shear deformation and the following ductile fracture in a punching operation. As a result, the inventors have made clear that rapid propagation of a crack formed at an initiation point of a fracture is more important for control of the burr size than early initiation of the fracture at inclusions as hitherto discussed. That is, in accordance with the inventors study, in a punching operation for a small hole, a crack is formed at the onset of the ductile fracture in the vicinity of a die edge, the crack propagates along the inclusions, then a slug is cut off from the hole. Through observation of the punching operation, the inventors have discovered that the rapider the propagation of crack the smaller the size of burr. Furthermore, the inventors have made clear that the MnS inclusion is more effective for propagation of a crack than the oxide-type inclusions. If the oxide-type inclusions are included in the alloy, Mn and S which form MnS combine with the oxide-type inclusions. As a result, MnS which is effective for improvement of punching properties does not sufficiently precipitate.

Additionally, the effect of S in the present invention does not relate to improvement of machinability, namely effect of lubrication by S as hitherto discussed, but relates to the propagation of a crack. That is, as S included in the alloy employs for rapid propagation along inclusions in ductile fracture, the effect of S can be obtained by a small amount of S in comparison with the amount of S necessary to improve machinability.

Thus, in accordance with the present invention, as the content of elements forming the oxide-type inclusions is controlled in a proper range and a suitable amount of S is added, a material which can satisfy the sever requirement with respect to burr formation in electron gun parts can be provided for the first time.

In order to manufacture the present invention, a smelted Fe-Ni alloy ingot or a continuous casting slab having the above chemical composition is hot rolled with or without forging, and cold rolling and annealing are repeatedly carried out to the slab so as to obtain a cold rolled plate having predetermined thickness, then the final annealing is carried out to the plate for finishing, and a material having a thickness of about 0.05 to 0.5 mm for punching is obtained. When the condition of the final anneal is properly controlled so as to regulate a crystal grain size of not less than 0.7 in grain size number, more preferable result can be obtained. Electron gun parts are manufactured from the material with or without coining.

DETAILED DESCRIPTION OF THE INVENTION

Figure 1:
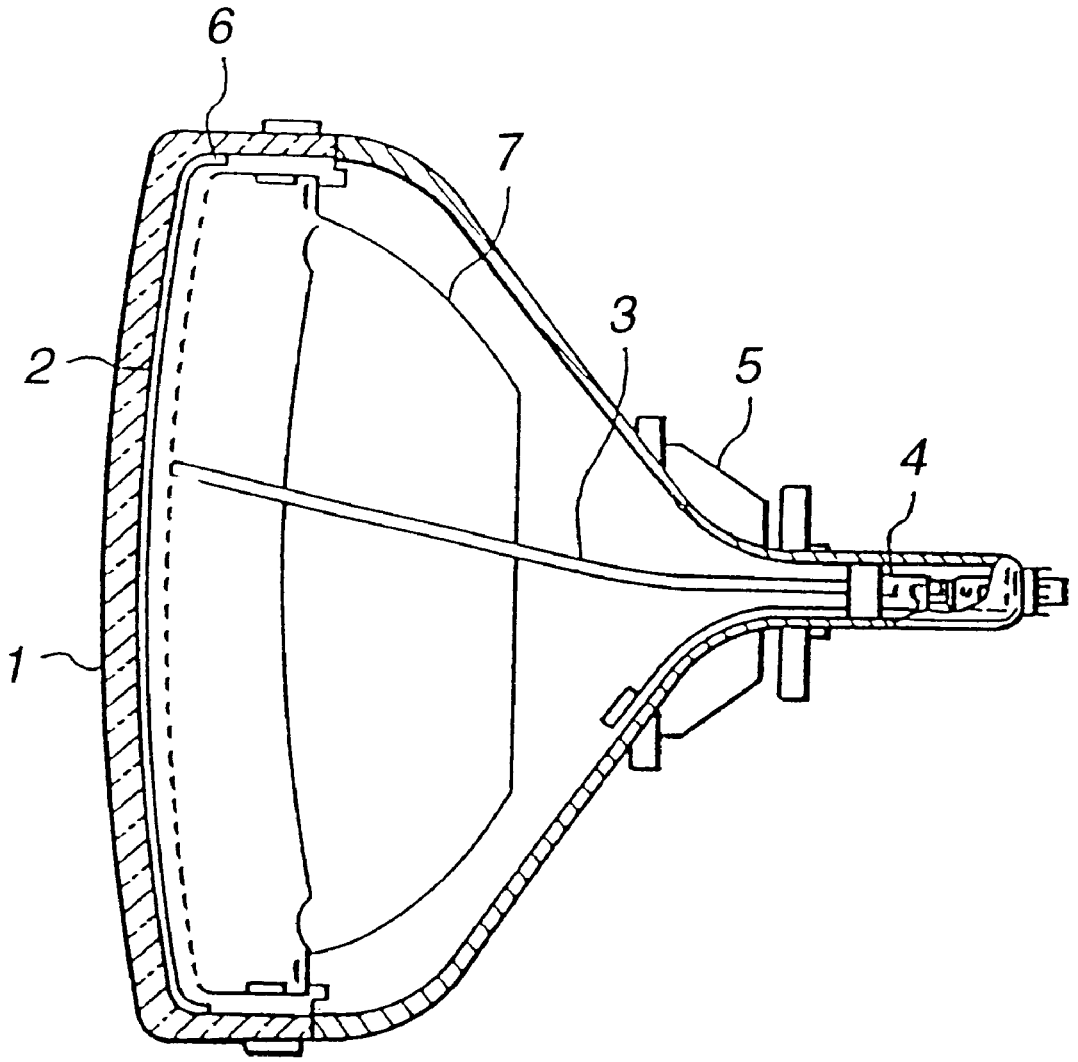
FIG. 1 is a cross sectional view of a shadow mask type picture tube.
Figure 2A:
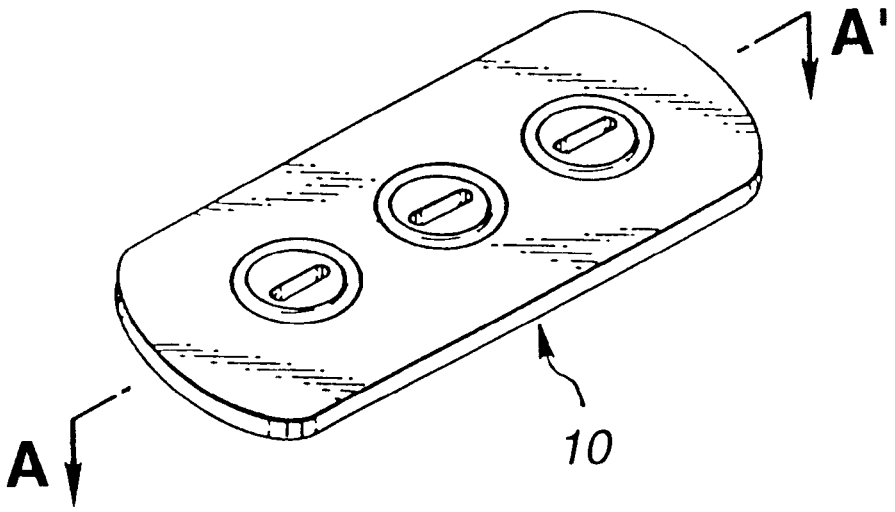
FIG. 2(*a*) is a perspective view of an electrode for an electron gun as an example of punched part according to this invention and FIG. 2(*b*) is cross sectional view taken along the line A–A' in FIG. 2(*a*).
Figure 2B:
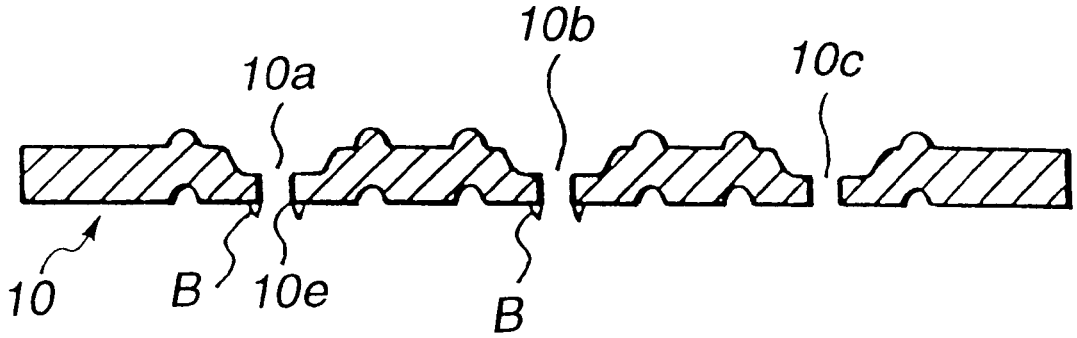

The present invention will be explained referring to the following description of examples of the invention and comparative examples. An Fe-Ni alloy including Fe-42 weight % Ni as a main component was smelted by vacuum induction melting, and some ingots with a weight of about 6 kg were obtained. The materials for the alloy were properly chosen from the group of electrolytic Fe, electrolytic Ni, electrolytic Mn, metallic Si and metallic Al. The S content was adjusted by mixing iron sulfide (Fe-S) to the material. The alloys which were not deoxidized by Si or Al were deoxidized by C.

Each ingot was hot rolled at 1200° C. into a 4 mm thick plate The plate was annealed and pickled, then was cold rolled into a 1.5 mm thick plate. Then, the plate was annealed and cold rolled into a 0.5 mm thick sheet. Then, the sheet was annealed in vacuum at 750° C. for 1 hour, so that test pieces were obtained.

Coining was carried out to each test piece, so that the thickness of the test pieces were reduced to 0.28 mm. Ten holes with diameter of 0.4 mm were punched out the test pieces. The maximum height of burrs formed circumference of the hole were measured, the punched surface of the holes were observed and a proportion of fracture surface with respect to entire inner side surface of the holes was measured for evaluation of the punching properties. In accordance with the studies of the inventors, it was found that the burr height decreases as the proportion of the fracture surface increases. Chemical composition of the examples of the invention and the comparative examples are shown in Table 1.

The maximum burr height and the proportion of fracture surface of the examples of the invention and the comparative examples are shown in Table 2. Wherein, "burr height" is defined as the distance from a lower edge of the hole when viewed from vertical section thereof to a lower edge of the burr (length of protrusion). "Thickness fraction of fracture surface (%)" is defined as (Thickness of fracture surface/Thickness of Plate) *100.

TABLE 1

| | Chemical Composition (weight %) | | | | | | | |
|---|---|---|---|---|---|---|---|---|
| No. | Ni | S | Mn | Si | Al | O | Fe | Remark |
| 1 | 41.2 | 0.0012 | 0.49 | <0.01 | 0.02 | 0.0024 | Balance | Example of Invention |
| 2 | 40.8 | 0.0028 | 0.51 | 0.12 | <0.01 | 0.0022 | Balance | Example of Invention |
| 3 | 41.0 | 0.0054 | 0.50 | 0.08 | 0.01 | 0.0019 | Balance | Example of Invention |
| 4 | 41.6 | 0.0080 | 0.48 | <0.01 | <0.01 | 0.0028 | Balance | Example of Invention |
| 5 | 41.6 | 0.0080 | 0.48 | <0.01 | <0.01 | 0.0028 | Balance | Example of Invention |
| 6 | 41.2 | 0.0126 | 0.49 | <0.01 | 0.02 | 0.0024 | Balance | Example of Invention |
| 7 | 40.6 | 0.0187 | 0.54 | <0.01 | <0.01 | 0.0038 | Balance | Example of Invention |
| 8 | 40.9 | 0.0063 | 0.18 | <0.01 | <0.01 | 0.0027 | Balance | Example of Invention |
| 9 | 41.1 | 0.0072 | 0.75 | 0.11 | <0.01 | 0.0023 | Balance | Example of Invention |
| 10 | 40.8 | 0.0006 | 0.48 | 0.01 | 0.01 | 0.0045 | Balance | Comparative Example |
| 11 | 41.3 | 0.0015 | 0.51 | <0.01 | <0.01 | 0.0067 | Balance | Comparative Example |
| 12 | 41.1 | 0.0033 | 0.46 | 0.02 | <0.01 | 0.0072 | Balance | Comparative Example |
| 13 | 41.7 | 0.0012 | 0.08 | 0.03 | 0.02 | 0.0041 | Balance | Comparative Example |

As can be seen from Tables 1 and 2, in all the examples of the invention, the maximum burr height is low and the thickness fraction of fracture surface is large, indicating that punching properties is superior compared to the comparative examples. More particularly, Comparative Example No. 10 exceeded in S content of the range of the invention, Comparative Example Nos. 11 and 12 exceeded in O content of the range of the invention and Comparative Example No. 13 exceeded in Mn content of the range of the invention. As a result, in these comparative examples, the maximum burr height is high and the proportion of the fracture surface is small, indicating that punching properties is inferior. Moreover, comparing Example of the Invention. No. 5 in which the crystal grain size is less than 7.0 in grain size number and No. 4 in which the crystal grain size is more than 7.0 in grain size number, in Example of the Invention No. 4, the maximum burr height is low and the proportion of fracture surface is large compared to No. 5.

TABLE 2

| No. | Crystal Grain Size (Grain Size No.) | Maximum burr height (μm) | Thickness fraction of fracture surface (%) | Remark |
|---|---|---|---|---|
| 1 | 10.0 | 3 | 30.2 | Example of Invention |
| 2 | 9.5 | 2 | 31.3 | Example of Invention |
| 3 | 9.5 | 2 | 32.2 | Example of Invention |
| 4 | 10.0 | 1 | 31.6 | Example of Invention |
| 5 | 6.0 | 3 | 30.3 | Example of Invention |
| 6 | 9.0 | 1 | 32.8 | Example of Invention |
| 7 | 9.5 | 1 | 33.4 | Example of Invention |
| 8 | 9.5 | 2 | 31.8 | Example of Invention |
| 9 | 9.5 | 1 | 32.0 | Example of Invention |
| 10 | 9.0 | 8 | 20.5 | Comparative Example |
| 11 | 9.5 | 7 | 22.3 | Comparative Example |
| 12 | 9.5 | 7 | 24.3 | Comparative Example |
| 13 | 9.5 | 8 | 21.8 | Comparative Example |

Thus, according to the Fe-Ni alloy for electron gun parts of the present invention, remarkably improved punching properties can be obtained, so that the problem of burrs which is fatal for electron gun parts can be solved, and superior electron gun parts which can accommodate to a tendency to grow higher quality of picture tubes can be obtained.

What is claimed is:

1. An Fe-Ni alloy for electron gun parts comprising, by weight:

30 to 55% of Ni; 0.0010 to 0.0200% of S; 0.1 to 0.8% of Mn; no more than 0.3% of Si; no more than 0.05% of Al; no more than 0.005% of O; and the balance Fe.

2. A press punched electron gun part manufactured from an Fe-Ni alloy comprising, by weight:

30 to 55% of Ni; 0.0010 to 0.0200% of S; 0.1 to 0.8% of Mn; no more than 0.3% of Si; no more than 0.05% of Al; no more than 0.005% of O; and the balance Fe.

3. An electron gun electrode manufactured from an Fe-Ni alloy comprising, by weight:

30 to 55% of Ni; 0.0010 to 0.0200% of S; 0.1 to 0.8% of Mn; no more than 0.3% of Si; no more than 0.05% of Al; no more than 0.005% of O; and the balance Fe.

4. An Fe-Ni alloy used for electron gun parts comprising, by weight:

30 to 55% of Ni; 0.0010 to 0.0200% of S; 0.1 to 0.8% of Mn; no more than 0.3% of Si; no more than 0.05% of Al; no more than 0.005% of O; and the balance Fe, said alloy having a crystal grain size of not less than 7.0 in grain size number based on JIS G 0551.

5. A press punched electron gun part manufactured from an Fe-Ni alloy comprising, by weight:

30 to 55% of Ni; 0.0010 to 0.0200% of S; 0.1 to 0.8% of Mn; no more than 0.3% of Si; no more than 0.05% of Al; no more than 0.005% of O; and the balance Fe, said alloy having a crystal grain size of not less than 7.0 in grain size number based on JIS G 0551.

6. An electron gun electrode manufactured from an Fe-Ni alloy comprising, by weight:

30 to 55% of Ni; 0.0010 to 0.0200% of S; 0.1 to 0.8% of Mn; no more than 0.3% of Si; no more than 0.05% of Al; no more than 0.005% of O; and the balance Fe, said alloy having a crystal grain size of not less than 7.0 in grain size number based on JIS G 0551.

* * * * *

UNITED STATES PATENT AND TRADEMARK OFFICE

CERTIFICATE OF CORRECTION

PATENT NO. : 5,962,965
DATED : October 5, 1999
INVENTOR(S) : N. Yuki, et al.

It is certified that error appears in the above-identified patent and that said Letters Patent is hereby corrected as shown below:

Title page,
"References Cited, FOREIGN PATENT DOCUMENTS: "3636815 10/1996 Japan" should read -- 3636815 10/1995 Germany --.

Signed and Sealed this

Twenty-sixth Day of February, 2002

*Attest:*

*Attesting Officer*

JAMES E. ROGAN
*Director of the United States Patent and Trademark Office*